US007201212B2

(12) United States Patent
Bullied et al.

(10) Patent No.: US 7,201,212 B2
(45) Date of Patent: Apr. 10, 2007

(54) INVESTMENT CASTING

(75) Inventors: Steven J. Bullied, Pomfret Center, CT (US); Maria A. Herring, Norwich, CT (US); W. Samuel Krotzer, Jr., Glastonbury, CT (US); Stephen D. Murray, Marlborough, CT (US)

(73) Assignee: United Technologies Corporation, Hartford, CT (US)

( * ) Notice: Subject to any disclaimer, the term of this patent is extended or adjusted under 35 U.S.C. 154(b) by 20 days.

(21) Appl. No.: 10/652,643

(22) Filed: Aug. 28, 2003

(65) Prior Publication Data

US 2005/0045301 A1 Mar. 3, 2005

(51) Int. Cl.
*B22C 9/04* (2006.01)
*B22D 27/04* (2006.01)
*B22D 33/04* (2006.01)

(52) U.S. Cl. ..... 164/516; 164/122.1; 164/137

(58) Field of Classification Search ..... 164/122.1, 164/122.2, 516, 137, 339–341
See application file for complete search history.

(56) References Cited

U.S. PATENT DOCUMENTS 3,802,482 A * 4/1974 Phipps, Jr. ..... 164/72
4,066,116 A * 1/1978 Blazek et al. ..... 164/17
4,170,256 A * 10/1979 Blazek et al. ..... 164/516
4,421,153 A 12/1983 Wilkinson et al.
4,552,197 A 11/1985 Mills
4,607,680 A * 8/1986 Mills et al. ..... 164/134
4,702,298 A * 10/1987 Blazek ..... 164/137
4,978,452 A * 12/1990 Aubrey ..... 210/510.1
5,295,530 A 3/1994 O'Connor et al.
5,505,250 A 4/1996 Jago
5,868,194 A 2/1999 Horwood
2001/0018960 A1 9/2001 Thompson et al.
2002/0005265 A1* 1/2002 Ford ..... 164/122.2

OTHER PUBLICATIONS

Search Report for European Patent Application No. 04254853.7.
Journal of Aeronautical Manufacturing Technology, 2002.
Technical Manual for Casting, Feb. 2003.
Chinese Office Action for CN Patent Application No. 200410076998.X.

* cited by examiner

*Primary Examiner*—Kuang Y. Lin
(74) *Attorney, Agent, or Firm*—Bachman & LaPointe, P.C.

(57) ABSTRACT

A method and apparatus are used to cast a number of elements such as turbine engine blades. The blades have an airfoil and a root for securing the blade to a disk. A number of mold sections each have internal surfaces for forming an associated at least one of the elements. The mold sections are assembled and molten alloy is introduced to the assembled mold sections.

26 Claims, 4 Drawing Sheets

INVESTMENT CASTING

BACKGROUND OF THE INVENTION (1) Field of the Invention

The invention relates to investment casting. More particularly, it relates to the investment casting of superalloy turbine engine components.

(2) Description of the Related Art

A well developed field exists regarding the investment casting of turbine engine parts such as blades and vanes. In an exemplary process, a mold is prepared having one or more mold cavities, each having a shape generally corresponding to the part to be cast. An exemplary process for preparing the mold involves the use of one or more wax patterns of the part. For manufacturing hollow parts, the patterns are formed by molding wax over a ceramic core generally corresponding to a positive of the interior spaces within the part. In a shelling process, a ceramic shell is formed around one or more such patterns in well known fashion. The wax may be removed such as by melting in an autoclave. This leaves the mold comprising the shell having one or more part-defining compartments which may, in turn, contain the ceramic core(s). Molten alloy may then be introduced to the mold to cast precursor(s) of the part(s). Upon cooling and solidifying of the alloy, the shell and core may be mechanically and/or chemically removed from the molded part precursor(s). The part precursor(s) can then be machined and treated in one or more stages to form the ultimate part(s).

SUMMARY OF THE INVENTION

One aspect of the invention involves a method for casting a number of blades, each having an airfoil and a root for securing the blade to a disk. A number of mold sections are formed each having internal surfaces for forming an associated at least one of the blades. A number of the mold sections are assembled. Molten alloy is introduced to the assembled mold sections.

In various implementations, the alloy may be simultaneously introduced to the assembled mold sections. Each of the sections may have internal surfaces for forming only a single associated blade. The surfaces of each of the mold sections may include first surfaces (e.g., of a mold shell) for forming an exterior of the associated blade and second surfaces (e.g., of a ceramic core) for forming an interior of the associated blade. The assembly may involve assembling the mold sections with a distribution manifold. Each of the mold sections may be formed by assembling a sacrificial blade pattern and a sacrificial feeding passageway pattern (form) atop a plate. A shell may be applied to the blade pattern and feeding passageway form. The shell may be heated to melt at least a portion of each of the blade pattern and feeding passageway form.

One aspect of the invention involves a method for casting a number of blades, each having an airfoil and a root for securing the blade to a separate disk. A plurality of mold sections are formed each having internal surfaces for forming an associated at least one of the blades and for forming an associated feeding passageway. A plurality of the mold sections are assembled with a single distribution manifold having a plurality of feeder conduits or branches so that each branch mates with an inlet of an associated one of the feeding passageways. Molten alloy is introduced to the assembled mold sections.

In various implementations, the alloy may be simultaneously introduced to the assembled mold sections. Each of the sections may have internal surfaces for forming only a single associated blade. The surfaces of each of the mold sections may include first surfaces (e.g., of a mold shell) for forming an exterior of the associated blade and second surfaces (e.g., of a ceramic core) for forming an interior of the associated blade. Each of the mold sections may be formed by assembling a sacrificial blade pattern and a sacrificial feeding passageway pattern (form) atop a plate. A shell may be applied to the blade pattern and feeding passageway form. The shell may be heated to melt at least a portion of each of the blade pattern and feeding passageway form.

Another aspect of the invention involves a method for casting parts. A plurality of mold sections are formed. A cluster of the mold sections is assembled. A distribution manifold is assembled to the cluster. The distribution manifold has a pour chamber for receiving molten material and a plurality feeder conduits each extending from the pour chamber toward an associated one or more of the assembled mold sections. The assembly may occur in a furnace. The mold sections may be inspected. The cluster may be of sections that have passed such inspection.

Another aspect of the invention involves a mold assembly having a plurality of mold sections. A distribution manifold is assembled to the mold sections. The distribution manifold has a pour chamber for receiving molten material and a number of feeder conduits each extending from the pour chamber toward an associated one or more of the mold sections. There are a plurality of filters, each positioned in an associated one of the feeder conduits.

BRIEF DESCRIPTION OF THE DRAWINGS

Like reference numbers and designations in the various drawings indicate like elements.

DETAILED DESCRIPTION

Figure 1:
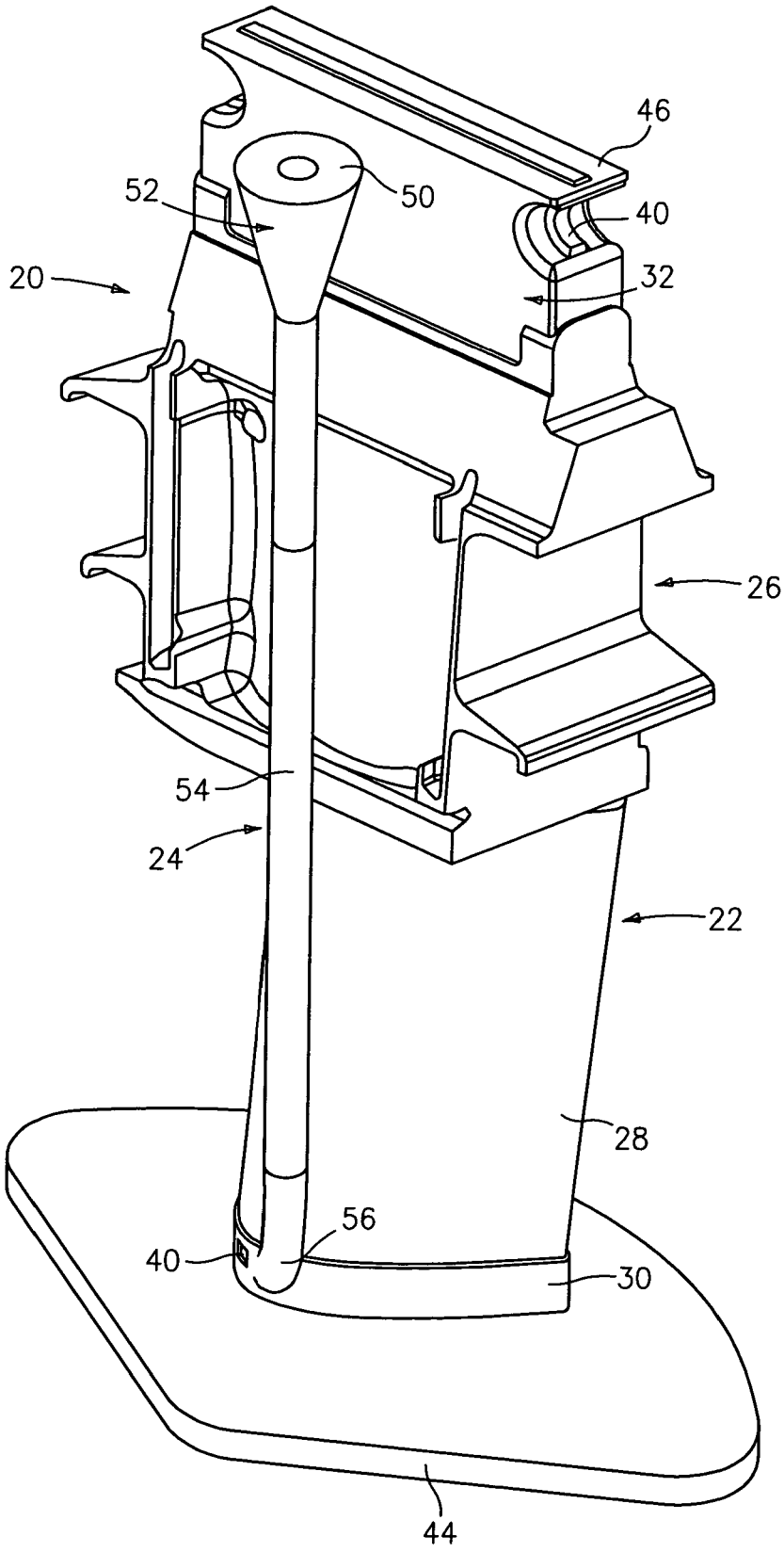
FIG. 1 is a view of a blade and gate pattern assembly.
Figure 2:
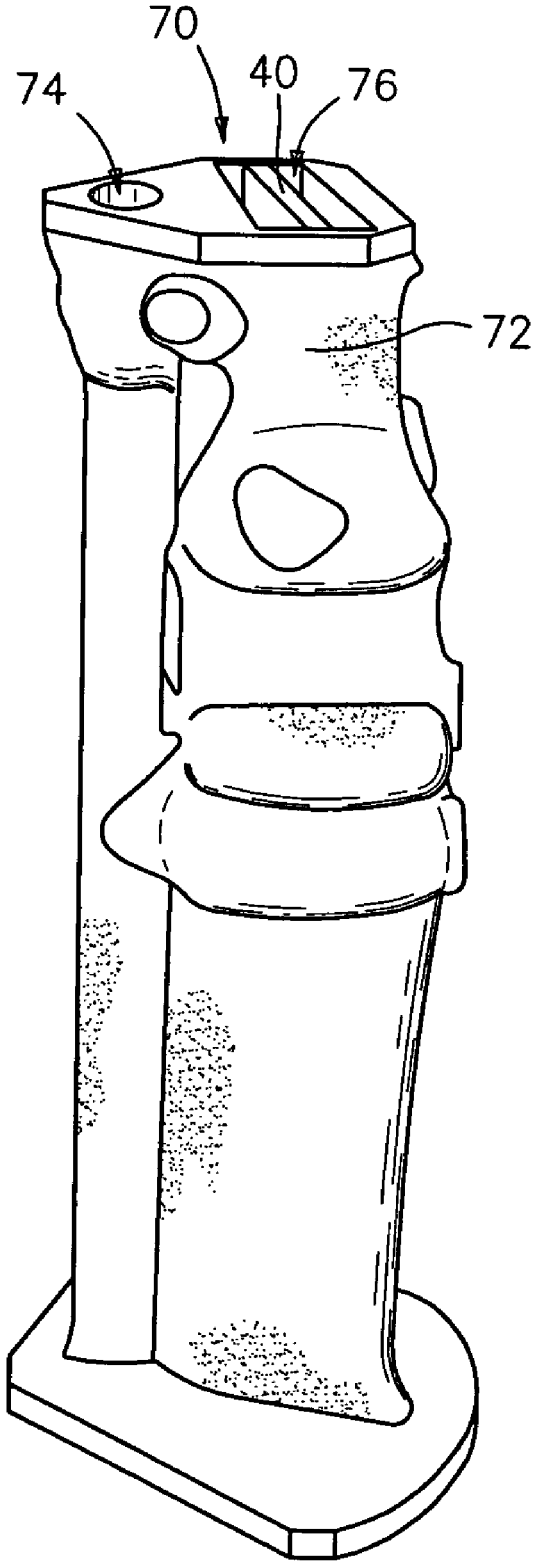
FIG. 2 is a view of a mold element produced from the pattern assembly of FIG. 1.

FIG. 1 shows a pattern assembly 20 including a blade pattern 22 and a feeding passageway pattern 24. The blade pattern has a root portion 26 formed in the shape of the ultimate blade mounting root and an airfoil portion 28 extending from the root portion and formed in the shape of the blade airfoil. Proximate the tip of the airfoil (at the bottom of the pattern as oriented), the blade pattern has a grain starter portion 30. An upper portion 32 extends from a proximal end of the root portion 26. The blade pattern is formed by molding wax over a ceramic core. In various locations the core 40 is exposed (e.g., through an illustrated gap in the grain starter and protruding from recesses in the upper portion). In the illustrated embodiment, the blade pattern is supported by the grain starter portion atop the upper surface of a metallic support plate 44. The upper portion has a flat upper surface 46 which abuts the underside of a top plate (not shown) and coupled to the bottom plate by connecting rods (also not shown) to hold the plates registered in a parallel, spaced apart relation. The exemplary top and bottom plates are formed essentially as sectors of a larger circular plate (e.g., 120° sectors with rounded corners).

From top-to-bottom, the feeding passageway pattern has a top surface 50 coplanar with the surface 46 and contacting the top plate underside. A downwardly tapering downsprue connector portion 52 depends from the surface 50 to a generally cylindrical downsprue portion 54. A feeder portion 56 depends from the downsprue portion 54 and flares outward to join the grain starter portion 30. In the exemplary embodiment, the feeding passageway pattern is formed as a unitary wax molding. The feeding passageway pattern may be wax welded to the grain starter.

FIG. 1 shows a pattern assembly 20 including a blade pattern 22 and a feeding passageway pattern 24. The blade pattern has a root portion 26 formed in the shape of the ultimate blade mounting root (that mounts/secures the blade to a separate disk which may be separately formed). The blade pattern also has an airfoil portion 28 extending from the root portion and formed in the shape of the blade airfoil. Proximate the tip of the airfoil (at the bottom of the pattern as oriented), the blade pattern has a grain starter portion 30. An upper portion 32 extends from a proximal end of the root portion 26. The blade pattern is formed by molding wax over a ceramic core. In various locations the core 40 is exposed (e.g., through an illustrated gap in the grain starter and protruding from recesses in the upper portion). In the illustrated embodiment, the blade pattern is supported by the grain starter portion atop the upper surface of a metallic support plate 44. The upper portion has a flat upper surface 46 which abuts the underside of a top plate (not shown) and coupled to the bottom plate by connecting rods (also not shown) to hold the plates registered in a parallel, spaced apart relation. The exemplary top and bottom plates are formed essentially as sectors of a larger circular plate (e.g., 120° sectors with rounded corners).

Figure 3:
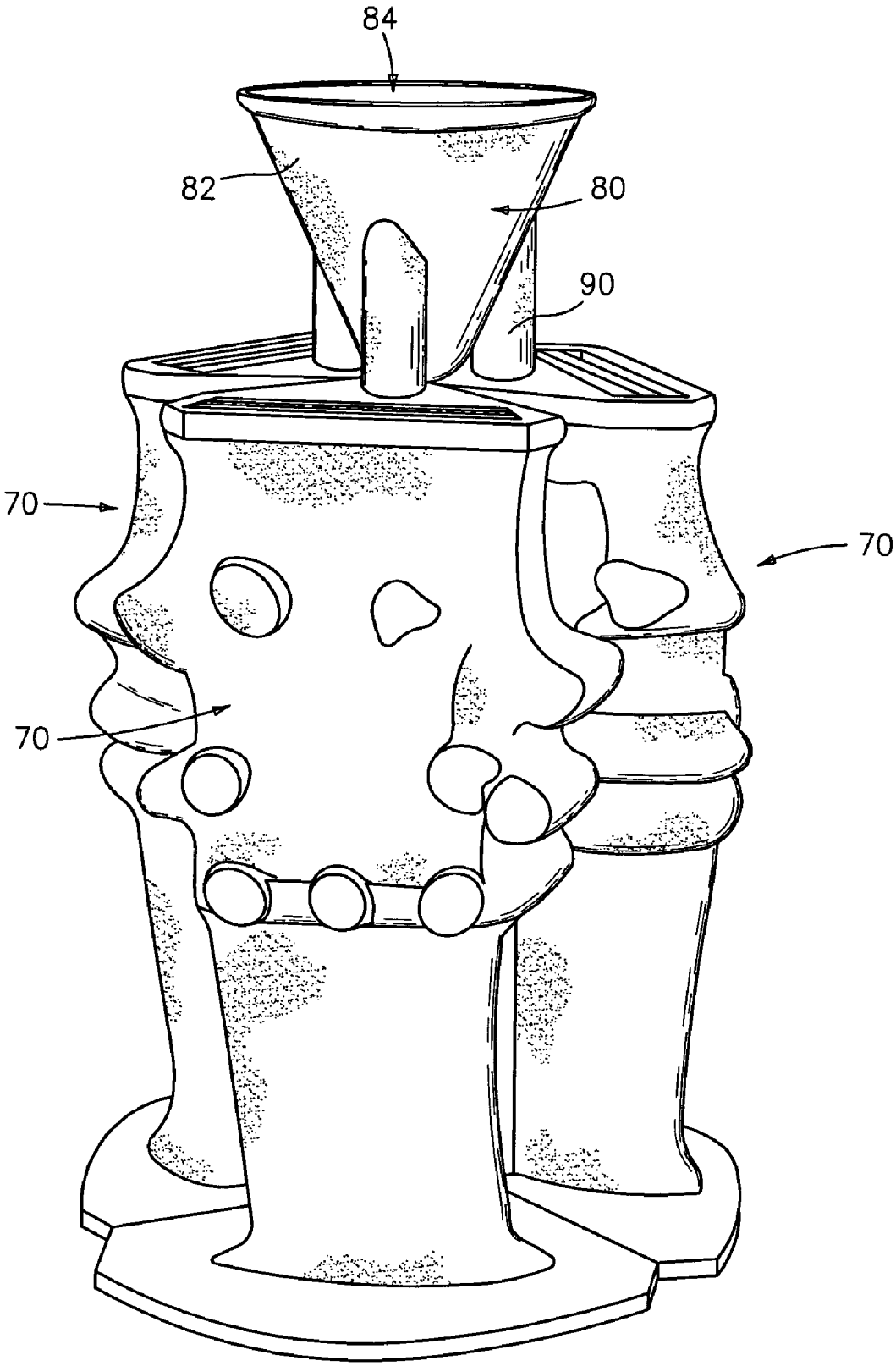
FIG. 3 is a view of a cluster of mold elements with a manifold.
Figure 4:
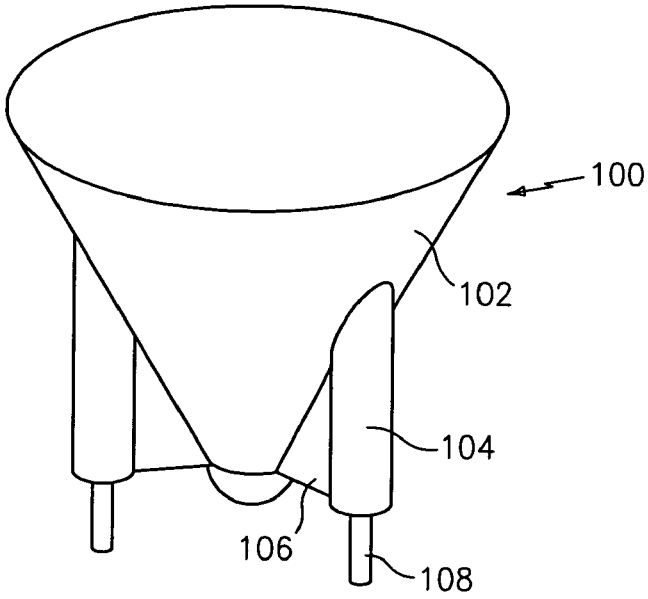
FIG. 4 is a view of a pattern for forming the manifold of FIG. 3.

FIG. 3 shows a cluster of three such molds assembled with a distribution manifold 80. The distribution manifold includes a pour cone 82 having an open upper end 84 for receiving molten metal. Three branches 90 descend from the cone and mate with the portion of the mold 70 defining the inlet to the feeding passageway 74. The manifold may be formed by similar shelling of a wax pattern 100 (FIG. 4). The pattern is formed with a main conical portion 102 from which three generally cylindrical proximal branch portions 104 depend. The proximal branch portions are connected to the main portion by structural webs 106. Smaller section/diameter metering portions 108 depend from the lower (distal) ends of the proximal branch portions 104.

Figure 5:
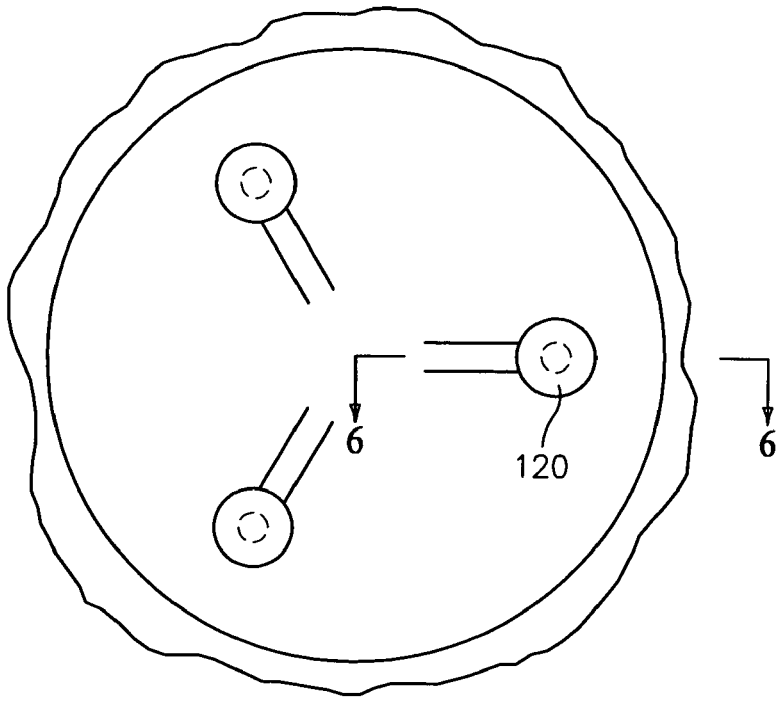
FIG. 5 is a top view of the manifold of FIG. 3.
Figure 6:
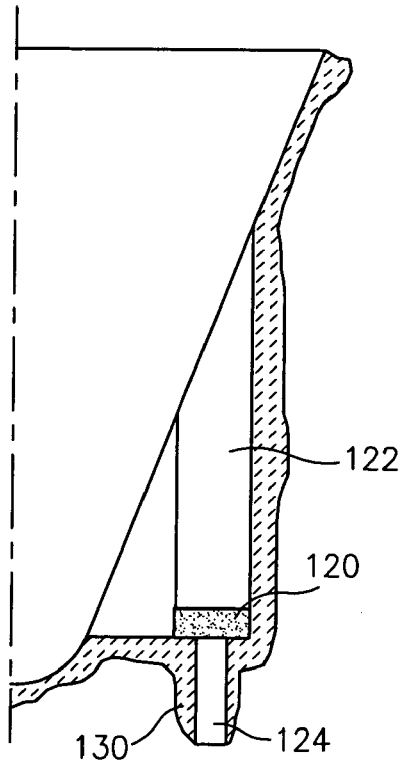
FIG. 6 is a sectional view of the manifold of FIG. 5 taken along line 6—6.

FIGS. 5 and 6 show the manifold after removal of the manifold pattern and after insertion of a ceramic filter 120 in each of the three branches supported on a shoulder between proximal and distal passageway (or conduit) portions 122 and 124 respectively formed by the surfaces of the pattern portions 104 and 108. The sectional area of each distal portion 124 is chosen to provide a desired metering of molten metal from the pour cone. The proximal portions are sized to receive the ceramic filters 120.

In the exemplary embodiment, three mold sections are assembled as a cluster in a furnace (not shown) atop a chill plate (not shown) and the manifold is positioned atop the cluster. In the exemplary embodiment, portions 130 of the manifold surrounding the passageway distal portions 124 extend into the upper ends of the feeding passageways. An exemplary distance of insertion of the portions 130 is 2–3 cm. The degree of insertion is preferably sufficient to help hold the manifold in place and upright during subsequent metal pouring (described below).

Once the mold is assembled, the molten metal may be poured into the manifold. The metal descends from the pour cone through the manifold passageways and their filters into the feeding passageways, filling the mold cavities from the bottom upward. The initial metal entering each mold cavity fills the grain starter portion of the mold cavity as metal flows upward through the mold cavity. Only enough metal is introduced to the manifold to raise the level in the mold cavities to a level within the upper portion of each mold cavity somewhat between the uppermost extreme of the root portion and the top of that mold cavity. This level is advantageously below the lower ends of the manifold metering portions. Heat transfer through the chill plate solidifies the metal in the cavities from the grain starters upward (the grain starters serving to establish the microstructure of the resulting castings). Accordingly, the patterns and associated shells may have been constructed to orient the blade-forming cavities so that the microstructure formation occurs in a desired direction from the grain starter (e.g., from blade airfoil tip to blade root in the exemplary embodiment). Alternative embodiments might lack the use of a separate manifold and may involve pouring metal into the mold sections individually.

The cooling leaves a casting in the blade-forming cavity and feeding passageway of each mold in the cluster. The casting, advantageously, does not extend into the manifold, permitting the manifold to be readily removed and also then permitting the filled molds to be individually removed.

From each filled mold, the shell and ceramic core may be mechanically and/or chemically removed. The portions of the casting formed by the grain starter, downsprue, feeder and upper portion may be cut away and the remaining blade form subject to further machining and/or additional treatment.

Implementations of the invention may have one or more advantages over various prior art casting techniques. By assembling a cluster of mold sections (each having chambers for molding one or more parts) permits inspection of the individual mold components and rejection of defective components individually. This is relative to a single piece mold having the same overall number of chambers wherein a defect in one chamber necessitates either discarding of the entire mold or inefficient use of the mold (e.g., wastage of a defective part cast in the defective chamber). As the individual mold components will be smaller than the corresponding single piece prior art mold, the shelling process may be easier. It may be easier to apply the shelling material and easier to dry the shell (both potentially quicker drying and potentially more even drying to reduce defects). The individual mold sections may be made using smaller shelling and autoclaving equipment The individual shells are lighter and more easily loaded into a furnace. More significantly, if the filled shells are individually removed from the furnace this is much easier than moving the correspondingly heavier filled single mold. By way of example, whereas an exemplary single piece mold filled by a single feeding passageway may weigh between seventy and one hundred pounds, each filled mold section of a similar three part plus manifold mold might weigh between thirty and forty pounds.

One or more embodiments of the present invention have been described. Nevertheless, it will be understood that various modifications may be made without departing from the spirit and scope of the invention. For example, details of the parts to be manufactured, the pattern making equipment available, the shelling equipment available, and the furnace available may influence details of any particular implementation. Accordingly, other embodiments are within the scope of the following claims.

What is claimed is:

1. A method for casting a plurality of blades having an airfoil and a root for securing the blade to a separate disk wherein each of the plurality of blades is formed as a separate casting, the method comprising:

forming a plurality of mold sections each having internal surfaces for forming an associated at least one blade of the plurality of blades and for forming an associated feeding passageway;

assembling the plurality of mold sections;

assembling the plurality of mold sections with a single distribution manifold having a plurality of feeder conduits so that each feeder conduit mates with an inlet of an associated one of the feeding passageways; and introducing a molten alloy to the assembled mold sections.

2. The method of claim 1 wherein:

the molten alloy is simultaneously introduced to the assembled mold sections.

3. The method of claim 1 wherein:

each of the mold sections has the internal surfaces for forming only a single such associated blade; and the internal surfaces of each of the mold sections include first surfaces for forming an exterior of the associated blade and second surfaces for forming an interior of the associated blade.

4. The method of claim 1 wherein:

the molten alloy is introduced so as to settle to an upper level below a lower extreme of flow path portions through the manifold.

5. The method of claim 1 wherein:

the distribution manifold comprises a manifold body having:

a pour chamber for receiving molten material; and said plurality of feeder conduits, each extending from the pour chamber to the associated feeding passageway; and the assembling comprises positioning each of a plurality of filters in an associated one of the feeder conduits.

6. The method of claim 1 wherein the forming of each of the mold sections comprises:

assembling a sacrificial blade pattern and a sacrificial gate form atop a plate;

applying a shell to the assembled blade pattern and gate form; and heating the shell to melt at least a portion of each of the blade pattern and gate form.

7. The method of claim 1 wherein:

the mold sections are assembled atop a chill plate.

8. The method of claim 1 wherein:

said internal surfaces of each of the mold sections form a mold cavity having a portion for forming the root of the associated blade.

9. The method of claim 8 further comprising:

cooling the molten alloy; and cutting away casting portions formed above the blade roots.

10. The method of claim 1 further comprising:

removing the distribution manifold;

individually removing the filled mold sections.

11. The method of claim 10 further comprising:

mechanically and/or chemically removing the mold sections from associated castings after said individually removing.

12. The method of claim 1 further comprising:

cooling the molten alloy to leave an associated casting in a blade forming cavity and feeding passageway of each mold section.

13. The method of claim 1 further comprising:

cooling the molten alloy to leave an associated casting in a blade forming cavity and feeding passageway of each mold section, the casting not extending into the distribution manifold.

14. A method for casting parts comprising:

forming a plurality of mold sections, each section having internal surfaces defining a mold cavity for forming one or more separate ones of said parts;

assembling a cluster of the mold sections so that the internal surface forming each mold cavity is separate from the others; and assembling a distribution manifold to the cluster, the distribution manifold having:

a pour chamber for receiving molten material; and a plurality of feeder conduits, each extending from the pour chamber toward an associated one or more of the assembled mold sections.

15. The method of claim 14 further comprising:

inspecting the mold sections and wherein the cluster is assembled from mold sections that have passed such inspection.

16. The method of claim 15 further comprising:

discarding one or more of the mold sections that have failed such inspection.

17. The method of claim 14 further comprising:

pouring the molten material into the pour chamber; and in a furnace, disassembling the manifold from the cluster and disassembling the cluster.

18. The method of claim 14 further comprising:

pouring the molten material into the pour chamber; and permitting the molten material to solidify to consist essentially of a nickel- or cobalt-based superalloy.

19. A mold assembly comprising:

a plurality of mold sections, wherein each section has internal surfaces forming a mold cavity separate from the others; and a separately formed distribution manifold assembled to the plurality of mold sections and having:

a single pour chamber in a first portion of the manifold for receiving molten material;

a plurality of feeder conduits, each formed in a branch portion of the manifold, unitarily formed as a common piece with the first portion and extending from the pour chamber toward an associated one or more of the plurality of mold sections; and a plurality of filters, each positioned in an associated one of the feeder conduits.

20. The mold assembly of claim 19 wherein:

there are exactly three or exactly four such mold sections; and there is a single such feeder conduit associated with each of the mold sections.

21. The mold assembly of claim 19 wherein:

each mold section comprises a molding cavity and a gate, the gate extending from a lower end at the molding cavity to an upper end coupled to the distribution manifold.

22. The mold assembly of claim 19 wherein:

the pour chamber is a centrally located chamber.

23. The mold assembly of claim 19 wherein:

sectional areas of the feeder conduits proximate the filters are dimensioned to provide metering of molten metal from the pour chamber.

24. The mold assembly of claim 19 wherein:

the plurality of mold sections are separate and assembled to the manifold with distal portions of the branch portions extending into upper ends of feeding passageways in the mold sections.

25. A mold assembly for molding a plurality of parts comprising:

a plurality of mold sections, each section having internal surfaces defining a mold cavity for forming one or more separate ones of said parts, wherein each mold cavity is separate from the mold cavities of the other sections; and a separately formed distribution manifold assembled to the plurality of mold sections and having:

a pour chamber for receiving molten material;

a plurality of feeder conduits, each extending from the pour chamber toward an associated one or more of the plurality of mold sections; and a plurality of filters, each positioned in an associated one of the feeder conduits.

26. A mold assembly comprising:

a plurality of mold sections, each section having internal surfaces defining a mold cavity for forming one or more separate ones of said parts, wherein each mold cavity is separate from the mold cavities of the other sections; and a separately formed distribution manifold assembled to the plurality of mold sections and having:

a unitarily-formed body defining:

a single pour chamber for receiving molten material; and a plurality of feeder conduits, each extending from the pour chamber toward an associated one or more of the plurality of mold sections; and a plurality of filters, each positioned in an associated one of the feeder conduits.

* * * * *